US005082428A

United States Patent [19]

Oklejas et al.

[11] Patent Number: 5,082,428

[45] Date of Patent: Jan. 21, 1992

[54] CENTRIFUGAL PUMP

[76] Inventors: Robert A. Oklejas, 774 E. Hurd Rd.; Eli Oklejas, Jr., 1648 W. Lorain, Apt. 202, both of Monroe, Mich. 48161

[21] Appl. No.: 568,472

[22] Filed: Aug. 16, 1990

[51] Int. Cl.[5] ..... F04B 77/00; F01D 25/22

[52] U.S. Cl. ..... 417/362; 417/366; 415/110; 415/131

[58] Field of Search ..... 417/362, 366; 415/110, 415/111, 112, 14, 47, 48, 131, 177, 180; 474/184, 166, 167

[56] References Cited

U.S. PATENT DOCUMENTS

| | | | |
|---|---|---|---|
| 802,775 | 10/1905 | McMurtry | 414/14 |
| 803,759 | 11/1905 | Herles et al. | 273/160 |
| 805,019 | 11/1905 | Krogh | 415/14 |
| 921,118 | 5/1909 | Kasley | 417/245 |
| 1,032,828 | 7/1912 | Hayton | 415/97 |
| 1,609,306 | 12/1926 | Peterson | 417/406 |
| 1,999,163 | 6/1929 | Allen | 415/112 |
| 2,331,641 | 10/1943 | Walker | 415/112 |
| 2,448,717 | 5/1945 | Jeffcock | 715/112 |

(List continued on next page.)

FOREIGN PATENT DOCUMENTS

| | | | |
|---|---|---|---|
| 3330364 | 3/1985 | Fed. Rep. of Germany . | |
| 3510160 | 9/1986 | Fed. Rep. of Germany . | |
| 161341 | 1/1988 | Norway . | |
| 81028 | 5/1970 | Switzerland | 415/62 |
| 128235 | 4/1960 | U.S.S.R. . | |
| 548180 | 9/1942 | United Kingdom . | |
| 2071765 | 3/1980 | United Kingdom . | |

OTHER PUBLICATIONS

"The R-O Turbocharger: A Breakthrough in Reverse Osmosis Power Recovery Technology", Pump Engineering, Inc.

"Development of Some Unconventional Centrifugal Pumps", *Proc. Instn, Mech. Engrs.*, vol. 174, No. 11, 1960.

"LPK/LPN Serla Slurry Pumps". Serlachius Engineering Works.

"Experiments With a Model Free Rotating Vaneless Diffuser." Rodgers et al., *Journal of Engineering Power*, Apr. 1975, pp. 231-244.

*Primary Examiner*—Richard A. Bertsch
*Assistant Examiner*—Peter Korytnyk
*Attorney, Agent, or Firm*—Emch, Schaffer, Schaub & Porcello Co.

[57] ABSTRACT

The invention is a centrifugal pump having an outer housing defining a pumping chamber. An impeller is rotatably positioned in the chamber for pumping a fluid. The impeller is mounted on the first end of a rotatable shaft. A journal bearing is positioned in the outer housing and disposed coaxially around the shaft. A small clearance space is present between the shaft and the journal bearing. The clearance space is in communication with the chamber whereby the fluid being pumped by the impeller is directed to said clearance space and the fluid provides the lubrication for the journal bearing. The impeller of the pump is moveable in the pumping chamber and positioned adjacent a first wall of the pumping chamber. An inverted tub is secured to the second end of the shaft and extends over a portion of the outer housing where the shaft is located. A drive belt engages the outer periphery of the inverted hub to rotate the inverted hub and impeller. The drive belt engages the inverted hub at substantially the midpoint of the journal bearing. A space is provided between the impeller and the second wall of the pumping chamber. The fluid being pumped enters the space and acts upon the impeller to bias the impeller towards the first wall. A groove is positioned in the first wall adjacent the impeller. A conduit extends from the groove to the discharge region for the pumped fluid whereby high pressure fluid from the discharge enters the groove to counteract the pressure from the space and the impeller is maintained in the desired position in the pumping chamber.

37 Claims, 2 Drawing Sheets

U.S. PATENT DOCUMENTS

| | | | |
|---|---|---|---|
| 2,601,030 | 6/1952 | Klein | 417/362 |
| 2,652,228 | 9/1953 | Merrick | 239/259 |
| 2,680,410 | 6/1954 | Kolb | 415/104 |
| 2,710,579 | 6/1955 | Kriegbaum | 417/365 |
| 2,739,782 | 3/1956 | White | 15/17 |
| 2,809,590 | 10/1957 | Brown | 417/357 |
| 2,864,314 | 12/1958 | Culleton | 415/111 |
| 2,909,590 | 10/1959 | Stanley | 174/162 |
| 3,265,000 | 8/1966 | Tyler et al. | 415/150 |
| 3,289,919 | 12/1966 | Wood | 415/150 |
| 3,365,120 | 1/1968 | Jassniker | 415/26 |
| 3,431,747 | 3/1969 | Hashem et al. | 62/123 |
| 3,784,318 | 1/1974 | Davis | 415/158 |
| 3,788,762 | 1/1974 | Partos | 415/111 |
| 3,899,875 | 8/1975 | Oklejas et al. | 60/39.51 R |
| 3,927,951 | 12/1975 | Mitsuhashi | 415/110 |
| 3,999,377 | 12/1976 | Oklejas et al. | 60/39.51 R |
| 4,029,438 | 6/1977 | Sloan | 417/200 |
| 4,036,584 | 7/1977 | Glass | 415/90 |
| 4,070,132 | 1/1978 | Lynch | 415/48 |
| 4,077,220 | 3/1978 | Matthews | 60/641 |
| 4,094,613 | 6/1978 | Bracken | 415/17 |
| 4,208,166 | 6/1980 | Schroeder et al. | 415/170 A |
| 4,227,865 | 10/1980 | Erickson et al. | 417/365 |
| 4,230,564 | 10/1980 | Keefer | 210/652 |
| 4,255,081 | 3/1981 | Oklejas et al. | 415/96 |
| 4,257,733 | 3/1981 | Bandukwalla et al. | 415/13 |
| 4,264,285 | 4/1981 | Erickson et al. | 417/405 |
| 4,265,589 | 5/1981 | Watson et al. | 415/47 |
| 4,378,194 | 3/1983 | Banduwalla | 415/49 |
| 4,391,102 | 7/1983 | Studhalter et al. | 60/649 |
| 4,408,953 | 10/1983 | Nasvytis et al. | 415/62 |
| 4,410,429 | 10/1983 | Harvey et al. | 210/416.1 |
| 4,416,583 | 11/1983 | Byrns | 415/148 |
| 4,419,046 | 12/1983 | Carlini | 415/127 |
| 4,460,310 | 7/1984 | Plunkett | 415/26 |
| 4,503,684 | 3/1985 | Mount et al. | 62/115 |
| 4,527,949 | 7/1985 | Kirtland | 415/150 |
| 4,543,036 | 9/1985 | Palmer | 415/1 |
| 4,830,572 | 5/1989 | Oklejas, Jr. et al. | 415/110 |
| 4,832,565 | 5/1989 | Dussourd | 415/110 |
| 4,966,708 | 10/1990 | Oklejas et al. | 210/637 |
| 4,983,305 | 1/1991 | Oklejas et al. | 210/642 |

CENTRIFUGAL PUMP

BACKGROUND OF THE INVENTION

The invention is directed to method and apparatus for a centrifugal pump and more particularly a high speed centrifugal pump. In high speed pump applications it has always been difficult to properly arrange the bearings that are used to support the shaft upon which the impeller is mounted. In most applications at least two sets of bearings are used to support the shaft and to accomodate the loads that are placed on the shaft by the drive means for the pump.

Frequently, the bearings are sealed in a special chamber and a particular lubricant such as oil is used to lubricate the bearings. The special lubricant is necessary to allow the bearings to effectively handle the loads placed on the shaft. However, it is necessary to seal the bearings in a manner where the lubricant does not leak into the pumping area and contaminate the fluid that is being pumped. Obviously, this is a complex and expensive way to provide support for the rotating impeller. Also, it is frequently difficult to detect leaks of the lubricant from the bearings until too late and a large quantity of the pumped fluid has been contaminated. It is also important that the pumped fluid not contaminate the lubricant as this can decrease the effectiveness of the lubricant and result in premature failure of the bearing.

In such a high speed pump there is usually an imbalance in the pressure exerted by the pumped fluid on the rotating impeller. At the inlet for the fluid the pressure is very low and usually the pressure from the pump fluid on the opposite side of the impeller is quite high. This creates a pressure imbalance on the impeller that can effect the operation of the high speed pump.

Accordingly, it would be desirable to have a high speed pump with a simplified arrangement for the bearings that support the shaft for the impeller. In particular, it would be preferable to utilize a single bearing that is lubricated in a manner that can not contaminate the fluid that is being pump. Also, it would be desirable to have an arrangement for the impeller that balances the force on the impeller to allow the pump to operate as efficiently as possible.

SUMMARY OF THE INVENTION

The invention is a centrifugal pump having an outer housing defining a pumping chamber and a method of operation for the centrifugal pump. An impeller is rotatably positioned in the chamber for pumping a fluid. The impeller is mounted on the first end of a rotatable shaft. A journal bearing is positioned in the outer housing and disposed coaxially around the shaft. A small clearance space is present between the shaft and the journal bearing. The clearance space is in communication with the chamber whereby the fluid being pumped by the impeller is directed to said clearance space and the fluid provides the lubrication for the journal bearing. The impeller of the pump is moveable in the pumping chamber and positioned adjacent a first wall of the pumping chamber. An inverted hub is secured to the second end of the shaft. The inverted hub extends over a portion of the outer housing where the shaft is located. A drive belt engages the outer periphery of the inverted hub to rotate the hub and impeller. The drive belt engages the inverted hub at substantially the center of the journal bearing. A space is provided between the impeller and the second wall of the pumping chamber. The fluid being pumped enters the space and acts upon the impeller to bias the impeller towards the first wall. A groove is positioned in the first wall adjacent the impeller. A conduit extends from the groove to the discharge region for the pumped fluid whereby high pressure fluid from the discharge region enters the groove to counteract the pressure from the space and the impeller is maintained in the desired position in the pumping chamber.

DETAILED DESCRIPTION OF THE INVENTION

This patent application relates to a centrifugal pump and a method of operation for the centrifugal pump. More particularly this patent application is directed to a high speed centrifugal pump utilizing a journal bearing that is lubricated by the fluid being pumped by the centrifugal pump and that has an improved thrust balancing system for the impeller of the pump. The details of the invention will be more readily understood by referring to the attached drawings in connection with the following description of the invention.

Figure 1:
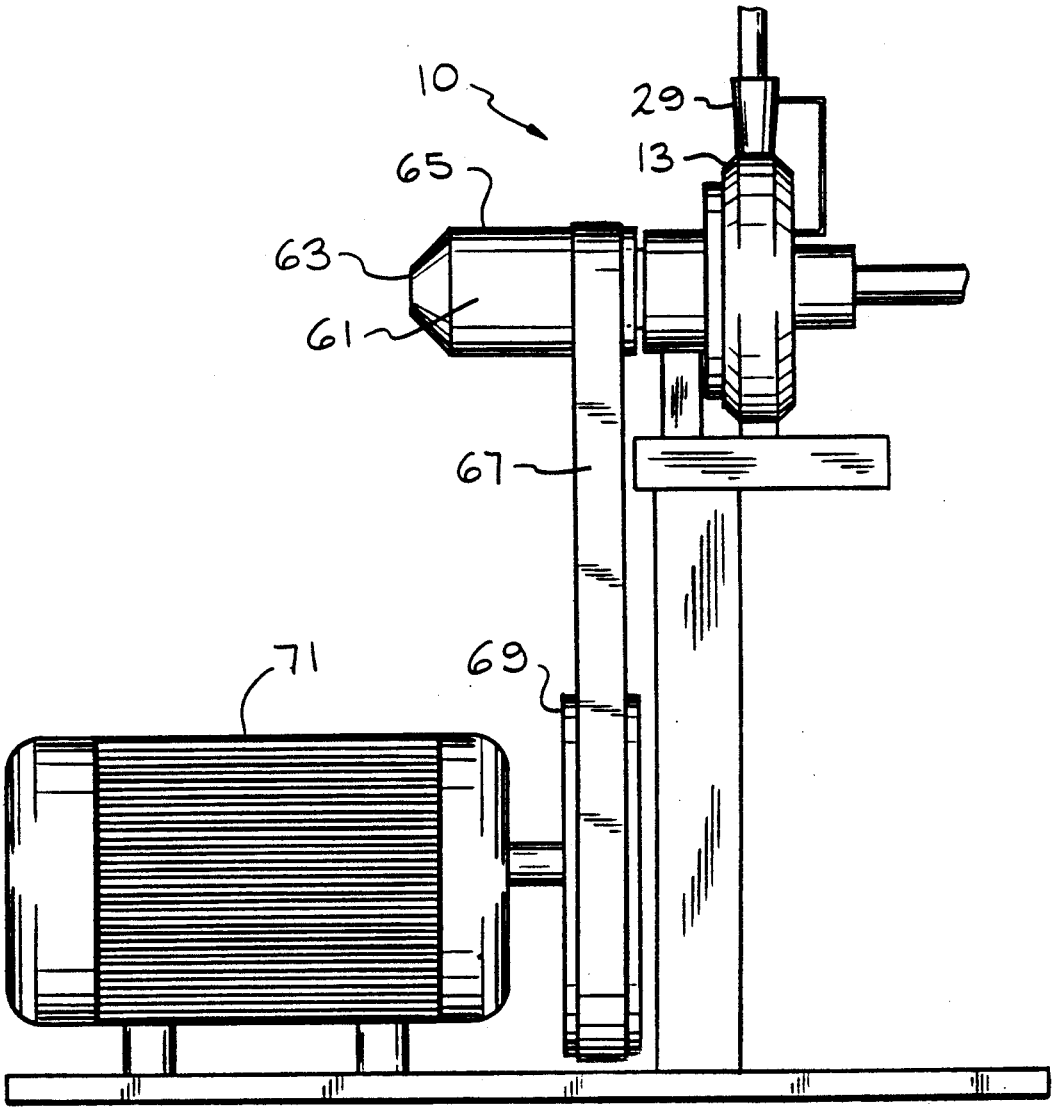
FIG. 1 is a side elevation view of the invention.
Figure 2:
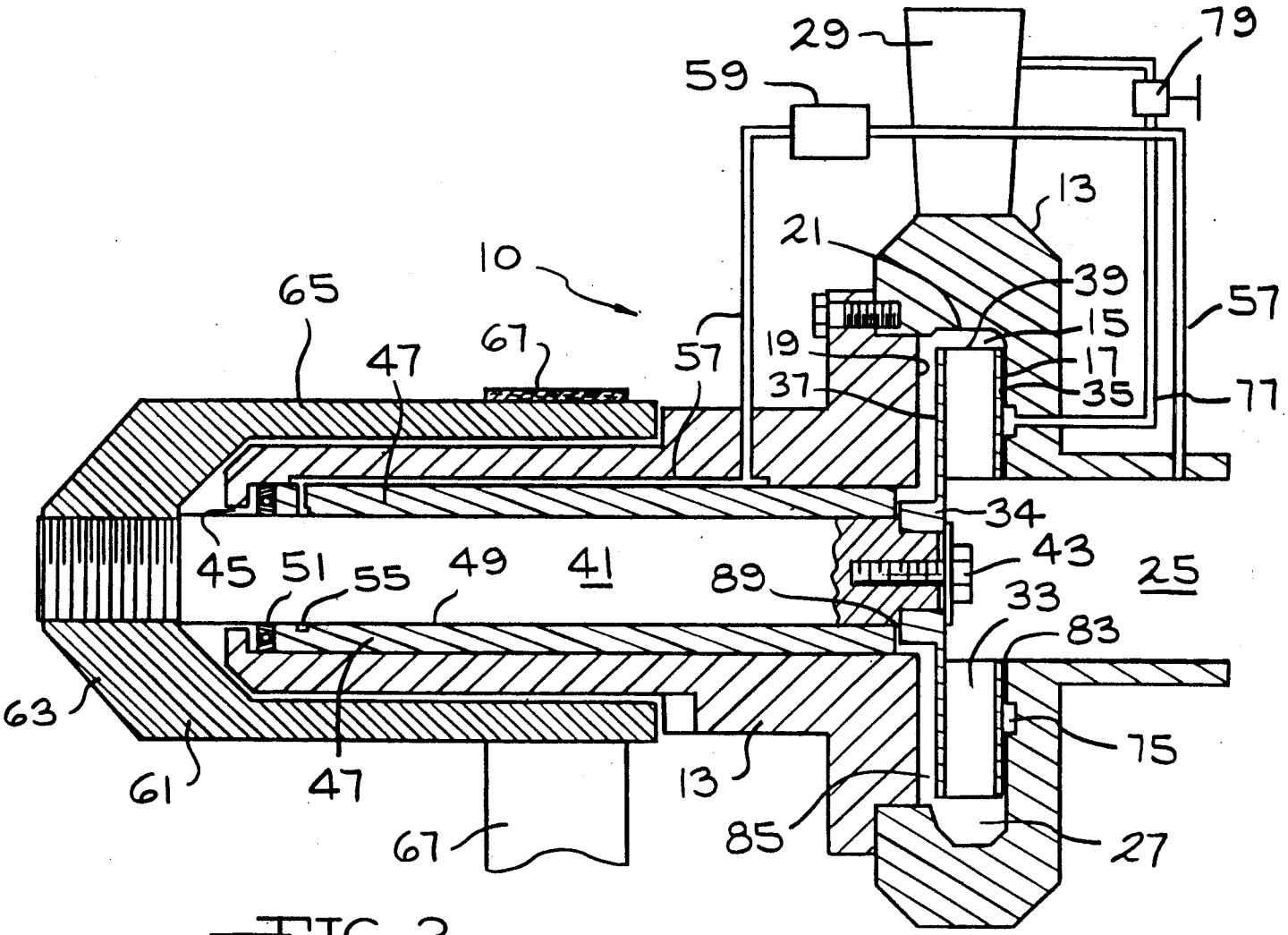
FIG. 2 is a cross-sectional view of the centrifugal pump.

Shown in attached FIGS. 1 and 2 is centrifugal pump 10 that has an outer housing 13. The outer housing 13 defines a pumping chamber 15. The pumping chamber 15 has a first wall 17 and a second wall 19 and the first and second walls are disposed in opposed substantially parallel relationship. The first and second walls of the pumping chamber 15 are connected by the outer periphery 21. The outer periphery 21 is disposed substantially perpendicular to the first and second walls. An inlet passageway 25 extends through the first wall 17 into the pumping chamber 15. The inlet passageway 25 is substantially in the center of the first wall 17 and is generally cylindrical in shape. A discharge passageway 27 is positioned in the outer periphery 21 of the pumping chamber 15. The discharge passageway 27 is connected to the diffuser 29 which is positioned on the outer housing 13 of the centrifugal pump 10.

An impeller 33 is rotatably positioned in the pumping chamber 15. The impeller has a first side 35 that is positioned adjacent the first wall 17 and a second side 37 that is positioned in spaced apart relationship to the second wall 19 of the pumping chamber 15. The first and second sides of the impeller 33 are disposed substantially parallel to the first and second walls of the pumping chamber 15. The impeller 33 terminates in an end region 39 that is adjacent the outer periphery 21 of the pumping chamber 15. The impeller is mounted on a shaft 41 and the shaft 41 extends away from the impeller 33 in a direction away from the inlet passageway 25. The impeller 33 has a hub 34 in the center region of the impeller and the hub is secured to the shaft 41 by any suitable securement means and in FIG. 2 a threaded bolt 43 is shown as one example of the securement means. The shaft 41 extends through an opening 45 in the portion of the outer housing 13 that extends away from the pumping chamber 15 in a direction opposite to the inlet passageway 25. A journal bearing 47 is positioned in the opening 45 and rotatably supports the shaft 41. The journal bearing 47 has a length that is from about 3 to about 5 times the diameter of the shaft 41. The shaft 41 has a diameter from about ¼ to about ½ of the outside diameter of the impeller 33. A small clearance 49 is provided between the outer surface of the shaft 41 and the inner surface of the journal bearing 47. An annular seal 51 can be positioned at the end of the journal bearing 47 and extends from the shaft 41 to the outer housing 13. The annular seal 51 effectively closes the end of the clearance 49 between the shaft 41 and the journal bearing 47. The annular seal 51 is positioned at the end of the journal bearing 47 that is spaced apart from the impeller 33.

A channel 55 is positioned in communication with the clearance 49 between the shaft 41 and the journal bearing 47. As shown in FIG. 2 the channel 55 is positioned radially around the inner surface of the journal bearing 47 that is adjacent to the outer surface of the shaft 41. However, the channel 55 can also be positioned radially around the shaft 41 or otherwise disposed in communication with the clearance 49. The channel 55 is normally located in close proximity to the annular seal 51 on the end of the shaft 41 that is spaced apart from the impeller 33. A passageway 57 connects to the channel 55 and extends from the channel 55 and is in communication with the inlet passageway 25 for the pumping chamber 15. A flow meter 59 can be positioned in the passageway 57.

The end of the shaft 41 that is spaced apart from the impeller 33 extends from the outer housing 13 of the centrifugal pump 10. Connected to this end of the shaft 41 is a cylindrical hub 61. The cylindrical hub 61 can be secured to the shaft 41 by any suitable means and in FIG. 2 it is shown as threadingly engaging a threaded portion of the shaft 41. The hub 61 has a base 63 that extends radially outwardly from the shaft 41. The hub has a cylindrical side wall 65 that is positioned coaxially around the outer housing 13 where the journal bearing 47 is located. The side wall 65 of the hub 61 is also coaxially positioned around the journal bearing 47 in the shaft 41. The side wall 65 of the cylindrical hub 61 extends from the base 63 in a direction toward the impeller 33. The side wall 65 of the hub 61 extends over at least one-half of the journal bearing 47 and in practice it has been found particularly advantageous to have the side wall 65 extend beyond the mid point of the journal bearing 47.

Positioned around the outer periphery of the cylindrical side wall 65 is an endless belt 67. The endless belt 67 also extends around a pulley 69 that is operatively connected to a drive motor 71. The endless belt 67 is generally a flat thin belt that is disposed to frictionally engage the outer surface of the side wall 65 of the hub 61 and also to frictionally engage the pulley 69 positioned on the drive motor 71. A suitable tensioning device (not shown) can be positioned along the length of the belt to ensure that the proper tension is maintained in the belt 67. In most applications the pulley 69 that is connected to the drive motor 71 will have a diameter that is considerably larger that the diameter of the side wall 65 of the hub 61.

Positioned in the first wall 17 of the pumping chamber 15 is a groove 75. The groove 75 is normally an annular groove that forms a substantially circular groove in the first wall 17. The area of the groove 75 is normally from about ½ and 1½ of the area of the shaft 41 upon which the impeller 33 is mounted. In practice it has been found preferable to have the area of the ring shaped groove 75 be substantially the same as the cross sectional area of the end of the shaft 41. The groove 75 is connected to a pipe 77 that extends to a high pressure region in the pump. Usually the pipe 77 is connected to the diffuser 29 that is connected to the discharge passageway 27 for the pumping chamber 15. A fluid control means 79 is positioned in the pipe 77. The fluid control means can be a valve as shown in FIG. 2 or other suitable means that can be utilized to regulate the flow of fluid through the pipe 77.

The impeller 33 is positioned in the pumping chamber 15 so that the first side 33 of the impeller is positioned immediately adjacent the first wall 17 of the pumping chamber 15. There is a small space 83 between the first side 35 of the impeller 33 and the first wall 17 of the pumping chamber 15. On the opposite side of the impeller 33 there is an open region 85 between the second side 37 of the impeller 33 and the second wall 19 of the pumping chamber 15. The open region 85 is also in communication with the clearance 49 between the shaft 41 and the journal bearing 47. To achieve this communication there is a small gap 89 between the hub 34 of the impeller 33 and the journal bearing 47.

In operation the drive motor 71 is activated which causes the pulley 69 to rotate. The rotation of the pulley 69 advances the belt 67 and the advancing belt causes the cylindrical hub 61 connected to the shaft 41 to rotate. As the hub 61 is connected to the shaft 41 the rotation of the hub will cause the shaft 41 to rotate. The impeller 33 is connected to the shaft 41 so the impeller 33 is also caused to rotate. The rotation of the impeller 33 creates a low pressure zone in the inlet passageway 25 to the pumping chamber 15. The low pressure zone assists in drawing the fluid supply to the inlet passageway 25 into the pumping chamber 15. The fluid engages the rotating impeller 33 and is advanced radially outwardly by the rotation of the impeller. As the fluid is displaced radially outwardly by the rotating impeller the velocity of the fluid increases. The increase in the velocity of the fluid increases the pressure in the fluid as the fluid moves radially away from the inlet passageway 25. As the fluid reaches the outer perimeter of the impeller 33 it advances into the discharge passageway 27 from the pumping chamber 15 and enters the diffuser 29. The diffuser 29 acts to reduce the velocity of the fluid in a manner where the pressure of the fluid is further increased.

For the centrifugal pump 10 to work properly it is important that the fluid being pumped does not leak back into the low pressure inlet passageway. Accordingly, the impeller 33 is positioned with the first side 35 of the impeller immediately adjacent the first wall 17 of the pumping chamber 15. The small space 83 between the first side 35 and first wall 17 inhibits the flow of fluid back into the inlet passageway 25. In this manner most of the fluid is discharged from the discharge passageway 27 and the efficiency of the pump is maintained.

However, the fluid being pumped can enter the open region 85 that is located between the second side 37 of the impeller 33 and the second wall 19 of the pumping chamber 15. The fluid in the open region 85 cannot flow back to the inlet passageway 25 because the hub 34 of the impeller 33 blocks the flow of the fluid back to the inlet passageway 25. The fluid in the open region 85 is under higher pressure than the fluid in the inlet passageway 25. The pressure of the fluid in the open region 85 and particularly the fluid that is adjacent the hub 34 of the impeller 33 acts to advance the impeller 33 towards the first wall 17 of the pumping chamber 15. As the impeller 33 is mounted on shaft 41 and the shaft 41 is positioned in journal bearing 47 the impeller and shaft 41 can move toward the first wall 17 in response to the pressure differential generated by the fluid in open region 85. The journal bearing 47 provides good support for the radial loads placed on the shaft 41 but does not resist axial loads placed on the shaft. Therefore, the shaft 41 and impeller 33 can move in a direction parallel to the axis of the shaft. The pressure differential on the impeller 33 acts to keep the first side 35 of the impeller 33 adjacent the first wall 17 of the pumping chamber 15. However, it is important that there be a small space 83 between the first side 35 and the first wall 17 or the impeller will hit the first wall 17 and be damaged or cease to rotate. To keep the impeller from hitting the first wall 17, groove 75 has been positioned in the first wall 17. The groove is connected to a region of high fluid pressure in the pump 10 such as the diffuser 29 by a pipe 77. The high pressure fluid in the diffuser 29 is routed to the groove 75 through the pipe 77 and this high pressure fluid acts against the first side 35 of the impeller 33 to balance the fluid pressure in the open region 85 on the opposite side of the impeller 33. A fluid control means 79 is positioned in the pipe 77 to control the quantity of fluid supplied to the grooves 75. By carefully sizing the groove 75 and controlling the fluid control means 79 it is possible to create an equilibrium position where the impeller 33 maintains the desired position adjacent the first wall 17 of the pumping chamber 15 to allow the centrifugal pump 10 to operate at a very efficient condition while at the same time preventing the impeller 33 from engaging the first wall 17 of the pumping chamber 15. Thus, the fluid in the groove 75 balances the forces on the impeller 33 and maintains the impeller in the desired position adjacent the first wall 17 of the pumping chamber. The close clearance between the impeller 33 and the first wall 17 results in very little leakage of fluid from the groove 75 and very little leakage of fluid between the impeller 33 and the first wall 17 back into the inlet passageway 28 and the efficiency of the pump 10 is maintained at a high level.

Once the desired equilibrium position is established the impeller will be self-adjusting to maintain this position throughout most operating conditions encountered by such a centrifugal pump. If for some reason the pressure of the fluid in the open region 85 increases the impeller 33 will be advanced toward the first wall 17 of the pumping chamber 15. This reduces the size of the small space 83 between the first wall 17 and the first side 35 of the impeller 33 and results in less fluid being discharged from the groove 75 into the small space 83. The decrease in the fluid discharged from the groove 75 causes the pressure of the fluid in the groove 75 to increase and this increase in pressure will eventually balance against the increased pressure in the open region 85 and the impeller will again reach an equilibrium position. When the conditions that created the increase in pressure in the open region 85 no longer exists there will be a reduction in the pressure of the fluid in the open region 85 and the increased pressure in the groove 75 will cause the impeller 33 to move in a direction towards the second wall 19 of the pumping chamber 15 until the original equilibrium position is obtained. If the pressure of the fluid in the open region 85 decreases due to a change in operating conditions, the pressure of the fluid in the groove 75 will force the impeller 33 to move towards the second wall 19 of the pumping chamber 15. This increases the size of the small space 83 between the first side 35 of the impeller 33 and the first wall 17 of the pumping chamber 15. The increase in the small space 83 will allow more fluid to flow from the groove 75 and this will decrease the pressure of the fluid in the groove 75 and an equilibrium position will be reached when the average pressure of the fluid in the open region 85 is the same as the average pressure of the fluid in the groove 75. Again, once the conditions change that resulted in a reduction of the fluid pressure in the open region 85 the fluid pressure forces on the impeller will change and the impeller will be moved back to the originally desired equilibrium position. This pressure balancing system allows the impeller to operate under most conditions encountered by such a centrifugal pump where high efficiencies can be maintained without damaging the impeller. The system also allows for a compensation if the impeller or the side walls of the pumping chamber become worn the pressure forces acting on the impeller 33 will cause the impeller to reach an equilibrium position that compensates for the wear. It is also possible to monitor the efficiency of the centrifugal pump 10 and to make adjustments in the fluid control means 79 to increase or decrease the amount of fluid supplied to the groove 75 to maintain the impeller 33 at an equilibrium position where the maximum practical efficiency for the centrifugal pump 10 can be obtained.

The fluid being pumped in open region 85 is also in communication with the clearance 49 between the shaft 41 and the journal bearing 47. The fluid under pressure reaches the clearance 49 through the gap 89 that is provided between the hub 34 of the impeller 33 and the journal bearing 47. The fluid under pressure passes along the clearance 49 and provides the lubricating fluid for the journal bearing 47. The pump 10 is normally used with low viscosity fluids such as water. Such low viscosity fluids are not suitable for forming a film that can effectively lubricate a bearing. To assist in using the low viscosity fluid as a lubricant it is helpful to have a relatively long journal bearing 47 and a shaft 41 with a relatively large diameter to maximize the potential for a fluid film to form between the journal bearing 47 and the shaft 41 during operation of the pump 10. It is also desirable to have the film thickness of the low viscosity fluid as uniform as possible along the length of the journal bearing 47. Having a journal bearing with a length from about 3 to about 5 times the diameter of the shaft 41 and a shaft 41 with a diameter from about ¼ to about ½ of the outside diameter of the impeller 33 greatly assists in using the low viscosity fluid as a lubricant.

After the fluid passes along substantially the entire length of the journal bearing 47 it reaches channel 55 located at the end of the journal bearing 47 that is spaced apart from the impeller 33. The fluid under pressure enters the channel 55 and passes through passageway 57 connected to the channel 55 and is directed back to the inlet passageway 25 for the centrifugal pump 10. In this manner the fluid that is being pumped acts as the lubricating fluid for the journal bearing and also provides cooling for the journal bearing as the fluid is continuously replaced. The fluid from the clearance 49 flows back into the inlet passageway 25 and again passes through the pump 10. Because the same fluid is used to lubricate the journal bearing that is being pumped the centrifugal pump 10 there is no need to seal the journal bearing from the impeller 33 or the pumping chamber 15 to avoid contamination of the fluid that is being pumped. The high pressure fluid that enters the clearance 49 is very effective in providing lubrication for the journal bearing and cooling for the journal bearing as there is a continuous flow of this fluid through the clearance 49.

The channel 55 and the passageway 57 effectively directs the fluid under pressure away from the clearance 49 after the fluid has been used to lubricate and cool the journal bearing. Thus, there is very low fluid pressure in the portion of the clearance 49 that is located between the channel 55 and the seal 51 that is positioned at the end of the journal bearing 47. This makes it much easier for the seal 51 to effectively seal the end of the clearance 49. In fact the fluid pressure in the portion of the clearance 49 located between the channel 55 and the seal 51 is usually approximately the same as the pressure present in the inlet passageway 25 for the centrifugal pump 10. If the channel 55 and passageway 57 did not direct the fluid back to the inlet passageway 25 the pressure on the seal 51 would be much greater and this could significantly reduce the life of the seal.

It is also possible to position a flow meter 59 in the passageway 57 to monitor the quantity of fluid that is flowing through the clearance 49 between the journal bearing 47 and shaft 41. If the quantity of fluid flowing through the flow meter 59 increases this can be an indication that the journal bearing 47 is becoming worn and may indicate that the journal bearing needs to be replaced. If the flow of fluid through the flow meter 59 decreases this can be an indication that there is a blockage in the clearance 49 or the passageway 57 and may be necessary to perform maintenance on the centrifugal pump to correct this problem. In either event, the flow meter 59 provides an indicator on how well the lubrication system and the journal bearing are functioning.

The belt 67 is positioned on the side wall 65 of the hub 61 so that the belt is substantially positioned over the centerline of the journal bearing 47. This balances the forces that are placed on the shaft 41 so the shaft is in proper alignment with the journal bearing 47. In effect the loads imposed by the drive belt 67 pass through the center of the journal bearing 47 and the shaft 41 remains parallel with respect to the walls of the journal bearing. This helps to ensure that the clearance 49 between the shaft 41 and the journal bearing 47 is as uniform as possible and allows an adequate fluid film to form in the journal bearing. This construction improves the effectiveness of the bearing, allows the bearing to be lubricated by the fluid that is being pumped and allows the shaft 41 to be supported with just one journal bearing which simplifies the construction of the centrifugal pump 10.

The above description of the invention is given for the sake of explanation. Various substitutions and modifications, other than those previously set forth, can be made without departing from the scope of the following claims.

We claim:

1. A centrifugal pump comprising:

an outer housing defining a pumping chamber;

an impeller rotatably positioned in said chamber for pumping a fluid, said impeller being mounted on the first end of a rotatable shaft; and, a journal bearing positioned in said outer housing and disposed coaxially around said shaft, a small clearance space being present between said shaft and said journal bearing, said first end of said clearance space closest to said impeller being in communication with said region of said chamber adjacent said first end of said shaft whereby said fluid being pumped by said impeller is directed to said first end of said clearance space, said fluid flowing from said end of said bearing that is positioned adjacent to said chamber to said end of said bearing that is spaced apart from said chamber, said fluid providing the lubrication for said journal bearing.

2. The pump of claim 1, wherein said journal bearing has a length that is from about 3 to about 5 times the diameter of said shaft.

3. The pump of claim 1, wherein said shaft has a diameter that is from about ¼ to about ½ of the outside diameter of said impeller.

4. The pump of claim 1, wherein said first end of said clearance space is in communication with said chamber adjacent said center of said impeller and a means for collecting said fluid from said clearance space is positioned at said end of said journal bearing that is spaced apart from said impeller.

5. The pump of claim 4, wherein said means for collecting said fluid is an annular groove positioned at said end of said journal bearing that is spaced apart from said impeller, said annular groove being disposed to collect said fluid that lubricates said journal bearing.

6. The pump of claim 5, wherein a passageway is connected to said annular groove, said passageway extending from said annular groove to said inlet for said pump whereby said fluid used to lubricate said journal bearing is recycled to said pump.

7. The pump of claim 5, wherein a seal is positioned at the end of said journal bearing that is spaced apart from said impeller, said seal being positioned beyond said annular groove, said seal keeping said fluid directed to said clearance space from being discharged from said end of said journal bearing.

8. The pump of claim 7, wherein said groove and passageway remove said fluid from said clearance space and reduce said fluid pressure on said seal that is positioned at the end of said journal bearing.

9. A centrifugal pump comprising:

an outer housing defining a pumping chamber;

an impeller rotatably positioned in said chamber for pumping a fluid, said impeller being mounted on the first end of a rotatable shaft;

a journal bearing positioned in said outer housing and disposed coaxially around said shaft, a clearance space being present between said shaft and said journal bearing, said first end of said clearance space closest to said impeller being in communication with said region of said chamber adjacent said first end of said shaft whereby fluid being pumped by said impeller is directed to said first end of said clearance space, said fluid flowing from said end of said bearing that is positioned adjacent to said chamber to said end of said bearing that is spaced apart from said chamber, said fluid providing lubrication for said journal bearing;

an annular groove positioned at said end of said journal bearing that is spaced apart from said impeller, said annular groove being disposed to collect said fluid that lubricates said journal bearing; and, a passageway connected to said annular groove, said passageway extending from said annular groove to said inlet for said pump whereby said fluid used to lubricate said journal bearing is recycled to said pump.

10. The pump of claim 9, wherein a seal is positioned at the end of said journal bearing that is spaced apart from said impeller, said seal being positioned beyond said annular groove, said seal keeping said fluid directed to said clearance space from being discharged from said end of said journal bearing.

11. The pump of claim 10, wherein said groove and passageway remove said fluid from said small clearance and reduce said fluid pressure on said seal that is positioned at the end of said journal bearing.

12. A centrifugal pump comprising:

an outer housing defining a pumping chamber;

an impeller rotatably positioned in said chamber for pumping a fluid, said impeller being mounted on the first end of a rotatable shaft;

a journal bearing positioned in said outer housing and disposed coaxially around said shaft, said journal bearing having a length from about 3 to about 5 times the diameter of said shaft, a clearance space being present between said shaft and said journal bearing, said clearance space being in communication with said chamber whereby said fluid being pumped by said impeller is directed to said clearance space and said fluid provides lubrication for said journal bearing;

an annular groove positioned at said end of said journal bearing that is spaced apart from said impeller, said annular groove being disposed to collect said fluid that lubricates said journal bearing;

a passageway connected to said annular groove, said passageway extending from said annular groove to said inlet for said pump whereby said fluid used to lubricate said journal bearing is recycled to said pump;

an inverted hub secured to said second end of said shaft, said inverted hub extending over a portion of said outer housing where said shaft is located; and, a drive motor positioned adjacent said pump, a drive belt extending from said motor and engaging the outer periphery of said inverted hub whereby rotation of said motor cause said belt to advance, causing said inverted hub to rotate which causes said shaft and said impeller to rotate to pump fluid through said pump.

13. The pump of claim 12, wherein said inverted hub extends over more than one-half of the length of said journal bearing and said drive belt engages said inverted hub at substantially the center of said journal bearing.

14. The pump of claim 12, wherein a flow meter is operatively connected to said passageway to measure the quantity of fluid passing through said passageway whereby the size of said clearance space can be monitored.

15. A centrifugal pump comprising:

an outer housing defining a substantially cylindrical pumping chamber, said pumping chamber having a first wall and a second wall disposed in opposed substantially parallel relationship and an outer periphery connecting the first and second walls;

an inlet passageway positioned in said first wall for admitting the fluid to be pumped to said pumping chamber;

a discharge opening positioned in said outer periphery of said pumping chamber to discharge said fluid to be pumped, said fluid being discharged having a pressure that is higher than said fluid entering said inlet passageway;

a rotatable impeller mounted on a shaft and positioned in said pumping chamber to pump said fluid from said inlet passage to said discharge opening and to increase the pressure of said fluid, said impeller being moveable in said pumping chamber in a direction substantially perpendicular to said first and second walls, said impeller having a desired position adjacent said first wall to prevent said fluid being pumped from leaking back into said inlet passage;

a space positioned between said impeller and said second wall of said pumping chamber, said fluid being pumped entering said space and acting upon said impeller to bias said impeller towards said first wall;

a groove positioned in said first wall, said groove being disposed to be adjacent said impeller; and a conduit extending from said groove to a high fluid pressure region for said pump, said groove and said conduit being of a size whereby said higher pressure fluid from said region enters said groove to counteract said pressure from said fluid in said space, if said pressure of said fluid in said space increases said impeller will move towards said first wall of said chamber and said clearance between said first wall and said impeller will decrease and this results in less fluid passing from said groove into the area between said impeller and said first wall which increases the fluid pressure from said groove acting on said side of said impeller adjacent said first wall of said pumping chamber, if said pressure in said space decreases said impeller will move away from said first wall of said chamber and said clearance between said first wall and said impeller will increase and this results in more fluid passing from said groove into the area between said impeller and said first wall which reduces the fluid pressure from said groove acting on said side of said impeller adjacent said first wall of said pumping chamber whereby said fluid pressure acting on said impeller are balanced and said impeller is maintained in substantially the desired position in said pumping chamber.

16. The pump of claim 15, wherein said groove has an area that is from about ½ to about 1½ times the cross sectional area of said shaft.

17. The pump of claim 15, wherein a valve is positioned in said conduit to control the flow of fluid under pressure to said groove to control the positioning of said impeller in said pumping chamber.

18. The pump of claim 15, wherein said impeller has side walls that are disposed substantially parallel to said first and second walls of said outer housing.

19. A centrifugal pump comprising:

an outer housing defining a pumping chamber, said pumping chamber having a first wall and a second wall disposed in opposed substantially parallel relationship and an outer periphery connecting the first and second walls;

an inlet passageway positioned in said first wall for admitting the fluid to said pumping chamber;

an impeller rotatably positioned in said chamber for pumping a fluid, said impeller being mounted on the first end of a rotatable shaft, said impeller being moveable in said pumping chamber in a direction substantially parallel to said axis of said shaft, said impeller being positioned adjacent said first wall to prevent said fluid being pumped from leaking back into said inlet passageway, said fluid pressure in said pumping chamber acting on said impeller to bias said impeller towards said first wall of said pumping chamber;

a journal bearing positioned in said outer housing and disposed coaxially around said shaft, a clearance space being present between said shaft and said journal bearing, said end of said clearance space closest to said impeller being in communication with said region of said chamber adjacent said first end of said shaft whereby fluid being pumped by said impeller is directed to said clearance space, said fluid flowing from said end of said bearing that is positioned adjacent to said chamber to said end of said bearing that is spaced apart from said chamber, said fluid providing lubrication for said journal bearing;

an annular groove positioned at said end of said journal bearing that is spaced apart from said impeller, said annular groove being disposed to collect said fluid that lubricates said journal bearing;

a passageway connected to said annular groove, said passageway extending from said annular groove to said inlet for said pump whereby said fluid used to lubricate said journal bearing is recycled to said pump;

a groove positioned in said first wall, said groove being disposed to be adjacent said impeller; and, a conduit extending from said groove to a high fluid pressure region for said pump whereby said higher pressure fluid from said region enters said groove to counteract said fluid pressure in said pumping chamber acting on said impeller whereby said impeller is maintained in the desired position in said pumping chamber.

20. The pump of claim 19, wherein said groove has an area that is from about ½ to about 1½ of the cross sectional area of said shaft.

21. A method for lubricating a journal bearing for a centrifugal pump comprising:

supplying a fluid to be pumped to a pumping chamber of said centrifugal pump;

rotating an impeller mounted on the first end of a shaft to pump said fluid from said pumping chamber;

directing a portion of said pumped fluid to a small clearance space between said journal bearing and shaft upon which said impeller is mounted, said end of said small clearance space closest to said impeller being in communication with said region of said pumping chamber adjacent said first end of said shaft whereby said pumped fluid flows from said end of said bearing that is positioned adjacent to said chamber to said end of said bearing that is spaced apart from said chamber to lubricate and cool said journal bearing.

22. The method of claim 21, in which said pumped fluid in said small clearance is collected when it reaches said end of said journal bearing that is spaced apart from said impeller.

23. The method of claim 22, in which said collected fluid is recycled back to said pumping chamber of said pump.

24. The method of claim 22, in which said fluid is collected in an annular groove positioned at the end of said journal bearing that is spaced apart from said impeller, a passageway being connected to said groove to recycle said fluid back to said pumping chamber.

25. The method of claim 24, in which a seal is positioned at the end of said journal bearing so that said pumped fluid in said clearance space enters said groove.

26. A method for balancing the forces on an impeller of a pump comprising:

rotating an impeller mounted on the first end of a shaft to pump fluid from said pumping chamber of said pump, said first side of said impeller being positioned immediately adjacent said first side wall of said pumping chamber to prevent said fluid from leaking back into said inlet passageway for said pump;

directing said fluid being pumped from said pumping chamber, said pumped fluid entering an open region adjacent to said second side of said impeller, said pumped fluid in said open region exerting a force on said second side of said impeller to advance said impeller towards said first side wall of said pumping chamber;

directing fluid from a high pressure region of said pump to a groove positioned in said first said wall of said pumping chamber, said groove being of a size whereby said fluid in said groove counteracts the force of said fluid under pressure in said open region if said pressure of said fluid in said space increases said impeller will move towards said first wall of said chamber and said clearance between said first wall and said impeller will decrease and this results in less fluid passing from said groove into the area between said impeller and said first wall which increases the fluid pressure from said groove acting on said side of said impeller adjacent said first wall of said pumping chamber, if said pressure in said space decreases said impeller will move away from said first wall of said chamber and said clearance between said first wall and said impeller will increase and this results in more fluid passing from said groove into the area between said impeller and said first wall which reduces the fluid pressure from said groove acting on said side of said impeller adjacent said first wall of said pumping chamber whereby said fluid pressure acting on said impeller are balanced and said impeller is maintained in substantially the desired equilibrium position adjacent said first side wall of said pumping chamber.

27. The method of claim 26, in which a valve is positioned in said conduit that provides said high pressure fluid to said groove, said valve controlling said high pressure fluid directed to said groove and said equilibrium position for said impeller.

28. A centrifugal pump comprising:

an outer housing defining a pumping chamber;

an impeller rotatably positioned in said chamber for pumping a fluid, said impeller being mounted on the first end of a rotatable shaft, said second end of said rotatable shaft that is opposite to said first end where said impeller is mounted extends from said outer housing;

a journal bearing positioned in said outer housing and disposed coaxially around said shaft, a small clearance space being present between said shaft and said journal bearing, said clearance space being in communication with said chamber whereby said fluid being pumped by said impeller is directed to said clearance space and said fluid provides the lubrication for said journal bearing; and, an inverted hub secured to said second end of said shaft, said inverted hub extending over a portion of said outer housing where said shaft is located.

29. The pump of claim 28, wherein a drive motor is positioned adjacent said pump, a drive belt extending from said motor and engaging the outer periphery of said inverted hub whereby rotation of said motor causes said belt to advance, causing said inverted hub to rotate which causes said shaft and said impeller to rotate to pump fluid through said pump.

30. The pump of claim 29, wherein said inverted hub extends over more than one-half of the length of said journal bearing.

31. The pump of claim 30, wherein said drive belt engages said inverted hub at substantially the center of said journal bearing.

32. The pump of claim 31, wherein said drive belt is a substantially flat belt.

33. A centrifugal pump comprising:

an outer housing defining a pumping chamber;

an impeller rotatably positioned in said chamber for pumping a fluid, said impeller being mounted on the first end of a rotatable shaft, said second end of said rotatable shaft that is opposite to said first end where said impeller is mounted extends from said outer housing;

a journal bearing positioned in said outer housing and disposed coaxially around said shaft, a clearance space being present between said shaft and said journal bearing, said clearance space being in communication with said chamber whereby fluid being pumped by said impeller is directed to said clearance space and said fluid provides lubrication for said journal bearing;

an inverted hub secured to said second end of said shaft, said inverted hub extending over a portion of said outer housing where said shaft is located;

an annular groove positioned at said end of said journal bearing that is spaced apart from said impeller, said annular groove being disposed to collect said fluid that lubricates said journal bearing; and, a passageway connected to said annular groove, said passageway extending from said annular groove to said inlet for said pump whereby said fluid used to lubricate said journal bearing is recycled to said pump.

34. The pump of claim 33, wherein a drive motor is positioned adjacent said pump, a drive belt extending from said motor and engaging the outer periphery of said inverted hub, said drive belt engaging said inverted hub at substantially the center region of said journal bearing.

35. A centrifugal pump comprising:

an outer housing defining a pumping chamber;

an impeller rotatably positioned in said chamber for pumping a fluid, said impeller being mounted on the first end of a rotatable shaft;

a journal bearing positioned in said outer housing and disposed coaxially around said shaft, a clearance space being present between said shaft and said journal bearing, said clearance space being in communication with said chamber whereby fluid being pumped by said impeller is directed to said clearance space and said fluid provides lubrication for said journal bearing;

an annular groove positioned at said end of said journal bearing that is spaced apart from said impeller, said annular groove being disposed to collect said fluid that lubricates said journal bearing;

a passageway connected to said annular groove, said passageway extending from said annular groove to said inlet said pump whereby said fluid used to lubricate said journal bearing is recycled to said pump; and, a flow meter operatively connected to said passageway to measure the quantity of fluid passing through said passageway whereby the size of said clearance space can be monitored.

36. The method of claim 21 in which the quantity of fluid passing through said passageway is measured by a flow meter operatively connected to said passageway whereby the size of said clearance space can be monitored.

37. A method for lubricating a journal bearing for a centrifugal pump comprising:

supplying a fluid to be pumped to a pumping chamber of said centrifugal pump;

rotating an impeller mounted on the first end of a shaft to pump said fluid from said pumping chamber, said impeller being rotated by the rotation of an inverted hub that is connected to said second end of said shaft and is positioned coaxially over said journal bearing and said shaft, a drive belt engaging said inverted hub at substantially the midpoint of said journal bearing for rotating said inverted hub, said shaft and said impeller rotating to advance fluid through said pump;

directing a portion of said pumped fluid to a small clearance between said journal bearing and shaft upon which said impeller is mounted, said small clearance being in communication with said pumping chamber whereby said pumped fluid acts to lubricate and cool said journal bearing.

* * * * *